US011554383B2

(12) United States Patent
Hoffmeister et al.

(10) Patent No.: US 11,554,383 B2
(45) Date of Patent: Jan. 17, 2023

(54) SYSTEM FOR LACQUER TRANSFER

(71) Applicant: Airbus Operations GmbH, Hamburg (DE)

(72) Inventors: Thomas Hoffmeister, Hamburg (DE); Pierre Zahlen, Stade (DE)

(73) Assignee: AIRBUS OPERATIONS GmbH, Hamburg (DE)

( * ) Notice: Subject to any disclaimer, the term of this patent is extended or adjusted under 35 U.S.C. 154(b) by 69 days.

(21) Appl. No.: 17/176,647

(22) Filed: Feb. 16, 2021

(65) Prior Publication Data

US 2021/0252547 A1 Aug. 19, 2021

(30) Foreign Application Priority Data

Feb. 17, 2020 (DE) ..... 102020104093.8

(51) Int. Cl.
*B05C 1/08* (2006.01)

(52) U.S. Cl.
CPC ..... *B05C 1/0808* (2013.01); *B05C 1/0813* (2013.01); *B05C 1/0821* (2013.01)

(58) Field of Classification Search
None
See application file for complete search history.

(56) References Cited

U.S. PATENT DOCUMENTS 5,849,082 A * 12/1998 Stefani ..... B28B 11/046 118/259
2009/0202745 A1* 8/2009 Pavani ..... H01L 31/186 427/595
2013/0101738 A1* 4/2013 Sollner ..... B05C 13/02 427/256
2017/0189927 A1* 7/2017 Miwa ..... B25J 9/0084
2017/0253768 A1* 9/2017 Kappeler ..... B05D 1/28
2021/0296097 A1* 9/2021 Kaneko ..... C23C 14/50

FOREIGN PATENT DOCUMENTS

| | | |
|---|---|---|
| DE | 29 39 102 | 4/1981 |
| DE | 37 21 593 | 1/1989 |
| DE | 20 2006 003265 | 6/2006 |
| EP | 0 978 263 | 2/2000 |
| EP | 3 213 824 | 9/2017 |
| JP | 2008-086882 | 4/2008 |
| JP | 2009-235357 | 10/2009 |
| WO | 2015/155128 | 10/2015 |

OTHER PUBLICATIONS

German Search Report for DE 102020104093.8, dated Sep. 29, 2020, 7 pages.

* cited by examiner

*Primary Examiner* — Charles Capozzi
(74) *Attorney, Agent, or Firm* — Nixon & Vanderhye P.C.

(57) ABSTRACT

A system for lacquer transfer is disclose having a device for lacquer transfer. The device includes a frame, a transfer roller with a circumferential lateral wall, and a slit nozzle for dispensing lacquer. The slit nozzle is connected to the frame. An outside contact surface of the lateral wall includes several depressions. The transfer roller is mounted rotatably to the frame. The slit nozzle is arranged contactless to or in direct contact with the outside contact surface of the lateral wall for dispensing lacquer into respective depressions in the lateral wall while the transfer roller is rotated. The transfer roller is configured to roll with the outside contact surface on a work surface of a work piece for transferring the lacquer from the depressions to the work surface.

11 Claims, 4 Drawing Sheets

SYSTEM FOR LACQUER TRANSFER

CROSS REFERENCE TO RELATED APPLICATION

This application claims priority to and incorporates by reference the entirety of German Application Number DE 10 2020 104 093.8, filed Feb. 17, 2020.

BACKGROUND

The present disclosure relates to a system for lacquer transfer to a work surface, in particular to an aerodynamic surface component of an aircraft, such as an outer surface component of a wing. The disclosure also relates to a method for lacquer transfer by such a system.

The system comprises at least one device for lacquer transfer. The device comprises a frame, a transfer roller with a circumferential lateral wall, and a nozzle in the form of a slit nozzle with a muzzle end for dispensing lacquer. The slit nozzle is directly or indirectly connected to the frame. An outside contact surface of the lateral wall comprises several depressions. The transfer roller is mounted rotatably about an axis of rotation at the frame. The slit nozzle is arranged contactless to or in direct contact with the outside contact surface of the lateral wall for dispensing lacquer into respective depressions in the lateral wall while the transfer roller is rotated about the axis of rotation. The transfer roller is configured to roll with the outside contact surface on a work surface of a work piece for transferring the lacquer from the depressions to the work surface of the work piece.

A similar system for lacquer transfer is known from WO 2015/155 128 A1.

In the known systems for lacquer transfer the frame is connected to a robot arm, so that lacquer is transferred to the work piece by moving the device with the robot arm along the work surface. However, it is very complex to achieve a high quality of lacquer transfer when the device is moved and transferring lacquer at the same time, specifically when the work piece has large dimensions and a complex shape, such as aircraft surface parts often do.

SUMMARY

The present disclosure provides a simplified system by which a high quality of lacquer transferred to the work surface can be achieved.

The present disclosure encompasses a system comprising the features of claim 1. Specifically, the system further comprises a positioning device configured for holding the work piece and moving the work piece along the transfer roller, so that the transfer roller rolls with the outside contact surface on the work surface of the work piece, for transferring lacquer from the depressions to the work surface. In such a way, the device does not need to be moved along the work surface when transferring lacquer at the same time. Instead, the device might be in a fixed position while the positioning device moves the work piece with the work surface along the device. In such a way, a high quality of lacquer transfer can be achieved by a comparably simple system.

The system might also include several devices for lacquer transfer arranged next to each other, for example in the form of a rotating revolver, for transferring lacquer to different work pieces, in particular differently sized or shaped work pieces, without needing to retrofit the transfer roller, the slit nozzle, or other parts of the device.

The device may further comprise a hardening unit that might be connected directly or indirectly to the frame and that might be formed as a UV-light unit configured for hardening the lacquer in a contactless way by emitting UV-light. UV-light within the meaning of the present invention is any kind of UV-radiation. The hardening unit might be arranged within an interior space defined by or formed within the transfer roller. The lateral wall of the transfer roller might be transparent for UV-light. The hardening unit might be arranged such that UV-light is emitted towards the work surface upon which the lateral wall of the transfer roller rolls, to harden the lacquer preferably immediately after it being transferred to the work surface.

The frame may form the bases of the device, since the slit nozzle and the hardening unit are each at least indirectly connected to the frame. For this purpose, the device may comprise further connecting means for connecting the slit nozzle to the frame and/or further connecting means for connecting the hardening unit to the frame. Thus, the slit nozzle and the hardening unit may be mounted to the frame. The slit nozzle may be releasably connected to the frame. Thus, the slit nozzle may be disconnected form the frame, in particular for a maintenance purpose. The slit nozzle may be connected to the frame, such that the slit nozzle can be releasably locked in a working position. If this lock is released, the slit nozzle may be pivoted via a hinge, which holds the slit nozzle at the frame. Thus, the slit nozzle may then be subject to a maintenance procedure.

The transfer roller is mounted rotatably to the frame. The transfer roller can therefore rotate about the axis of rotation. For this purpose, the device may comprise a drive unit, which is configured to drive the transfer roller in a rotation direction of the transfer roller about the axis of rotation. The drive unit may also be at least indirectly connected or mounted to the frame. During use, the drive unit drives the transfer roller, such that the transfer roller rotates about the axis of rotation and roles with the contact surface on a work surface. Furthermore, the work piece is moved translational in parallel to the device by the positioning device, while the transfer roller rotates, such that the transfer roller rolls on the work surface for transferring lacquer.

The slit nozzle may be connected via a pipe or a tube to a lacquer supply unit, which may be configured to supply the lacquer via the tube or the pipe to the slit nozzle. The lacquer can be hardened via UV-light. The lacquer supplied to the slit nozzle may be a liquid medium or a viscous medium.

According to a first nozzle arrangement of the slit nozzle, the muzzle end of the slit nozzle may be arranged contactless to the outside contact surface of the lateral wall for dispensing lacquer into respective depressions.

According to an alternative second nozzle arrangement of the slit nozzle, the muzzle end of the slit nozzle is arranged in direct contact with the outside contact surface of the lateral wall for dispensing lacquer into respective depressions.

If reference is subsequently made to the slit nozzle without explicitly specifying the first or second nozzle arrangement, the corresponding explanations may, in principle, apply as exemplary embodiments to each of the two arrangements. Therefore, it may be possible to apply the respective explanations to one of the first and second nozzle arrangement or to both nozzle arrangements.

The slit nozzle is configured for dispensing lacquer into the depressions of the lateral wall of the transfer roller. The slit nozzle may also be configured for dispensing lacquer onto depression-free sections of the lateral wall of the transfer roller. Thus, the slit nozzle may be configured for dispensing a lacquer film onto the lateral wall of the transfer roller, wherein the lacquer of the lacquer film fills the depressions and the lacquer film extends in axial direction and partly in circumferential direction of the transfer roller. The lacquer film may therefore theoretically divide into a depression part, which fills the depressions, and a remaining part, which is also referred to as bulk or a bulk part. Therefore, the transfer roller may be configured to roll with the contact surface of the transfer roller on a work surface of a work piece for transferring the lacquer from the contact surface to the work surface of the work piece, such that the lacquer film is transferred to the work surface. This encompassed the transfer of the lacquer from the depressions, but also the transfer of the bulk part. If the transfer of the lacquer from the depressions to the work surface, in particular to a surface of a wing, is described in the following, this may not exclude the possible transfer of the bulk part to the respective surface and/or the possible transfer of the lacquer from the depressions via the lacquer film.

Resulting from the direct contact between the muzzle end of the slit nozzle and the outside surface of the lateral wall of the transfer roller, if the slit nozzle may be in the second nozzle arrangement, a desired fill level of the depressions may be ensured and/or a desired mean thickness of the lacquer film may be ensured. However, a resulting contact force and/or a resulting contact friction should not change as much as possible during a rotation of the transfer roller in order to prevent a slip-stick-effect.

But a desired fill level of the depression may also be ensured and/or a desired mean thickness of the lacquer film on the outside surface of the lateral wall may be ensured, if the muzzle end of the slit nozzle is arranged contactless to the outside contact surface of the lateral wall, in particular, if the slit nozzle is arranged according to the first nozzle arrangement. A distance formed by the gap between the slit nozzle and the outside contact surface at the second deformation section may be predefined by an arrangement of the slit nozzle according to the second nozzle arrangement, such that lacquer dispensed by the slit nozzle continuously forms the lacquer film on the on the outside surface of the lateral wall, which may include a predefined thickness. The dispensed lacquer therefore fills the aforementioned gap with the lacquer. As an effect, lacquer also fills the depressions of the outside contact surface at the second deformation section of the lateral wall. As a further effect, a bulk part may also be applied to the outside contact surface at the second deformation section of the lateral wall.

According to an exemplary embodiment, the device is fixedly mounted to a static base structure, preferably by the frame. This might include that the position of the device might be adjustable relative to the base structure during a preparatory step where no lacquer transfer is carried out, while during lacquer transfer the position of the device is fixed relative to the base structure, e.g. screwed, clamped, or welded. The positioning device may be mounted to the base structure such that the work piece held by the positioning device is movable relative to the base structure. In such a way, the device does not need to be moved during lacquer transfer which increases the quality of lacquer transfer.

In particular, the positioning device may comprise a static base portion fixedly mounted to the base structure, and a movable portion movably mounted to the base portion and including or holding a work piece holder for holding the work piece. This might include that the position of the base portion might be adjustable relative to the base structure during a preparatory step where no lacquer transfer is carried out, while during lacquer transfer the position of the device is fixed relative to the base structure, e.g. screwed, clamped, or welded. In such a way, only the movable portion of the positioning device is moved during lacquer transfer while the device and the base portion of the positioning device are in a static position fixed to the base structure. This leads to a high quality of lacquer transfer.

The positioning device may be formed as a robot, wherein the movable portion includes a movable robot arm movably mounted to the base portion and holding the work piece holder, such that the work piece holder is movable by the robot arm relative to the base portion. By such a movable robot arm the work piece can be moved in multiple, preferably all, degrees of freedom in a very precise manner.

Alternatively, the positioning system may be formed as a roller system, wherein the base portion includes a roller track and the movable portion includes a carriage engaged with the roller track by rollers and configured for moving along the roller track and holding the work piece holder, such that the work piece holder is movable by the carriage relative to the roller track. Such a roller system relates to a particularly simple positioning device.

According to an alternative embodiment, the positioning device is formed as a magnetic positioning device comprising a magnetic field generator fixedly mounted to the base structure and configured to generate and control a magnetic field, and a magnetic part configured for being moved within the magnetic field by adapting the magnetic field by the magnetic field generator, and including a work piece holder for holding the work piece. The magnetic field generator might include electromagnets and/or permanent magnets and/or supra conductors. By such a magnetic positioning device a contactless positioning of the work piece is enabled.

According to an exemplary embodiment, the work piece holder is formed as a jig or a template may be adapted or adaptable to the shape, i.e. to the dimensions and/or the surface contour, of a specific work piece. A certain jig might thus be associated with a specific work piece or a specific group of work pieces. The jig might support the work piece along one entire side of the work piece or only at certain points. By such a jig, the work piece can be held and moved by the positioning device in a simple and reliable way, and the work piece can be attached to the jig in a preparatory step before actually connecting the jig to the positioning device for lacquer transfer.

In particular, the work piece holder may include a quick connector for quickly coupling the work piece holder to the movable portion of the positioning device. The quick connector may allow to couple the work piece holder to the movable portion without the aid of a technician or of further tools, merely by moving the movable portion into engagement with the quick connector work piece holder, which might be a snapping engagement or other self-engaging engagement. In particular, the quick connector might include a set of cones or cylinders for positioning and a set of balls or pins for locking. By such a quick connector the prepared work piece holder can be picked up by the positioning device in a quick and simple manner without requiring manual attachment work.

The system may further comprise a preparation area, such as a preparation cell, proximate to, and may be adjacent to the positioning device, for preparing work piece holders with work pieces attached thereto, i.e. for coupling the work pieces to the corresponding work piece holders. The positioning device is configured such that the movable portion can pick up or connect to the work piece holder together with the work piece from the preparation area. By such a preparation area proximate to the positioning device, the step of preparing the work piece and work piece holder can be integrated with the lacer transfer process by the system.

According to an exemplary embodiment, the system further comprises a lacquer transfer cell housing the device and the positioning device and connected to or including the base structure. Such a lacquer transfer cell protects the lacquer transfer process from undesired external influences and protects any workers nearby from UV-light and toxic vapours.

In particular, the lacquer transfer cell may comprise a door, e.g. an automatic shutter, that is movable between a closed position where the lacquer transfer cell is closed to the environment, and an open position where the lacquer transfer cell is open to the preparation area, so that the movable portion of the positioning device can reach though the open door and pick up or connect to the work piece holder together with the work piece from the preparation area. In such a way, a very quick and integrated process can be carried out by the system.

The disclosure also relates to a method for lacquer transfer to a work surface. The method comprises the steps of a) providing the system according to any of the afore described embodiments, and b) holding and moving a work piece with the positioning device along the transfer roller, so that the transfer roller rolls with the outside contact surface on the work surface of the work piece, for transferring lacquer from the depressions to the work surface. The features and effects described above in connection with the system apply vis-à-vis to the method.

According to an exemplary embodiment, prior to transferring lacquer to the work piece, the work piece is attached to the work piece holder in the preparation area. Before attaching the work piece to the work piece holder, the work piece may be delivered to the preparation area, its kind and/or shape is identified to identify the required movement path of the positioning device and/or the required device for lacquer transfer. In such a way, a very smooth and integrated process is provided.

In particular, prior to or after attaching the work piece to the work piece holder, parts of the work surface, such as start and stop areas, may be masked by one or more masking elements. The masking might be done e.g. by 3D-printed parts. Complex masking can easily be applied to the work piece in the preparation area before the work piece holder is connected to the positioning device.

Also, after attaching the work piece to the work piece holder and/or after masking the work surface the movable portion of the positioning device may reach through the opened door in the lacquer transfer cell to the preparation area, couples to the work piece holder, and moves the work piece holder to the device for lacquer transfer, preferably through the opened door into the lacquer transfer cell. In such a way, a very smooth and integrated process is provided.

BRIEF DESCRIPTION OF THE DRAWINGS

Further features, advantages and application possibilities of the present invention may be derived from the following description of exemplary embodiments and/or the Figures. Thereby, all described and/or visually depicted features for themselves and/or in any combination may form an advantageous subject matter and/or features of the present invention independent of their combination in the individual claims or their dependencies. Furthermore, in the Figures, same reference signs may indicate same or similar objects.

DETAILED DESCRIPTION OF SOME EMBODIMENTS

Some embodiments will now be described with reference to the Figures.

Figure 1:
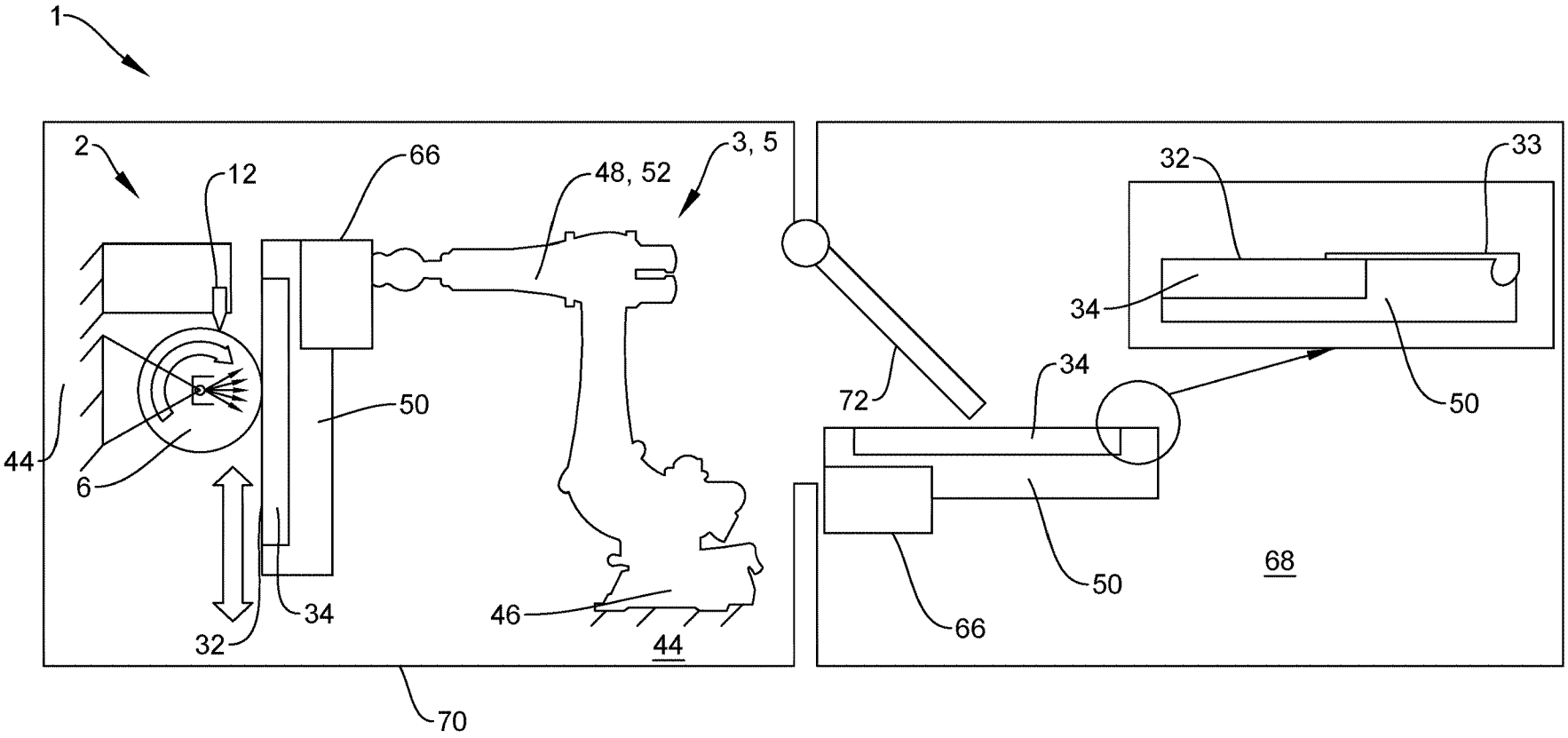
FIG. 1 schematically illustrates a system for lacquer transfer according to a first embodiment of the invention, where the positioning device is formed as a robot.

FIG. 1 schematically illustrates a first embodiment of a system 1 for lacquer transfer. The system 1 comprises a device 2 for lacquer transfer and a positioning device 3. The positioning device 3 in the first embodiment shown in FIG. 1 is formed as a robot 5. The device 2 is configured for transferring a lacquer onto a work surface 32 of a workpiece 34. The work piece 34 in the present embodiment is a wing component of an aircraft.

Figure 2:
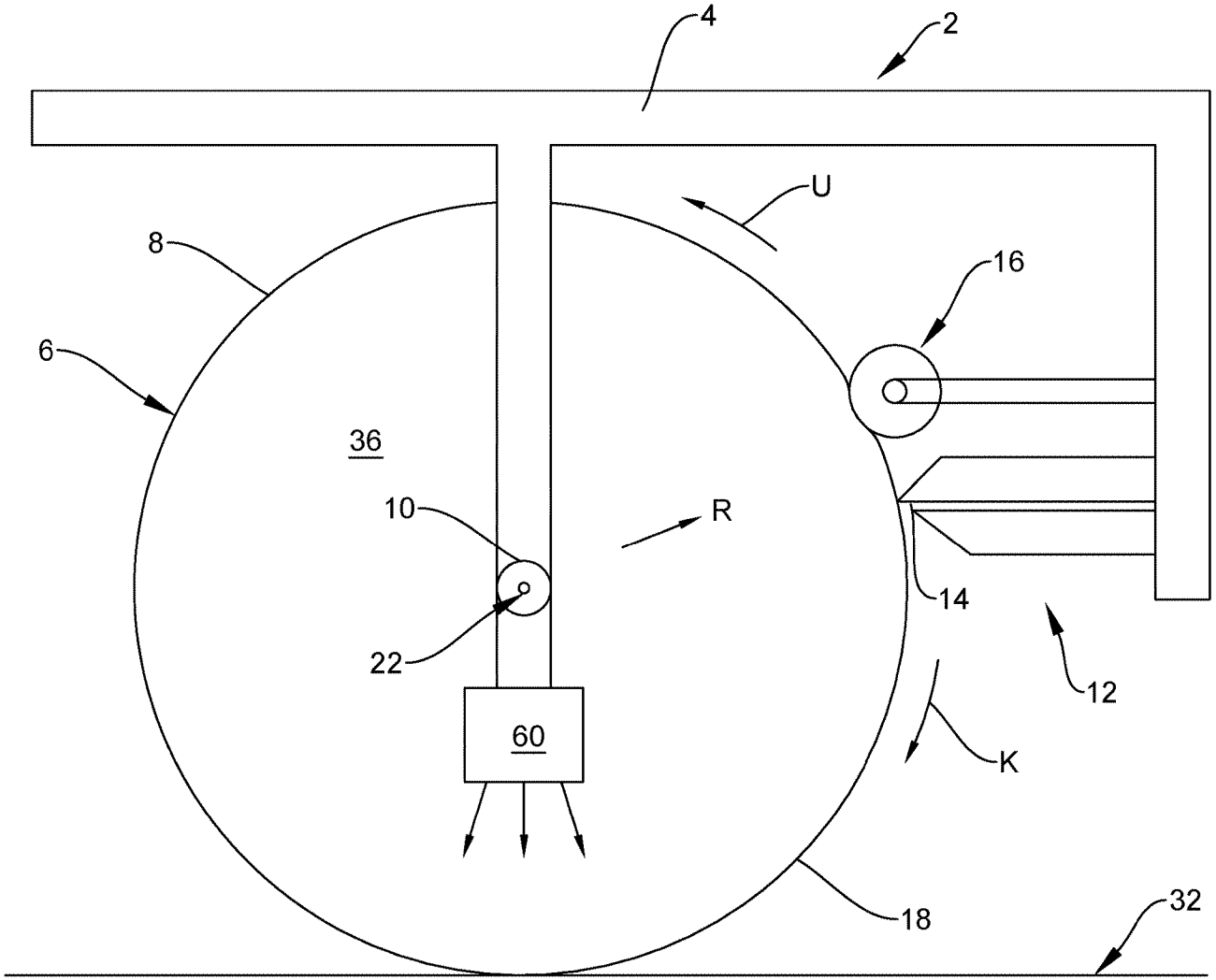
FIG. 2 schematically illustrates the device for lacquer transfer from the system shown in FIG. 1 in a cross-sectional view.

A first embodiment of the device 2 is schematically illustrated in FIG. 2 in a cross-sectional view. The device 2 comprises a frame 4, a transfer roller 6 with a circumferential lateral wall 8, a drive unit 10, a slit nozzle 12 with a muzzle end 14 for dispensing lacquer, and a deformation unit 16. The transfer roller 6 may also be referred to as a transfer tire. The device 2 can be attached via the frame 4 to a static base structure 44. The frame 4 may be adapted to be releasably connected to the base structure 44.

The transfer roller 6 is mounted rotatably, in particular by means of at least one bearing, about an axis of rotation 22 at the frame 4. An outside contact surface 18 of the lateral wall 8 comprises several depressions 20. The depressions 20 may be evenly or stochastically distributed about the circumference of the lateral wall 8. The FIGS. 3 and 4 show a part of the transfer roller 6 in a cross-section view and a top view, respectively.

Figure 3:
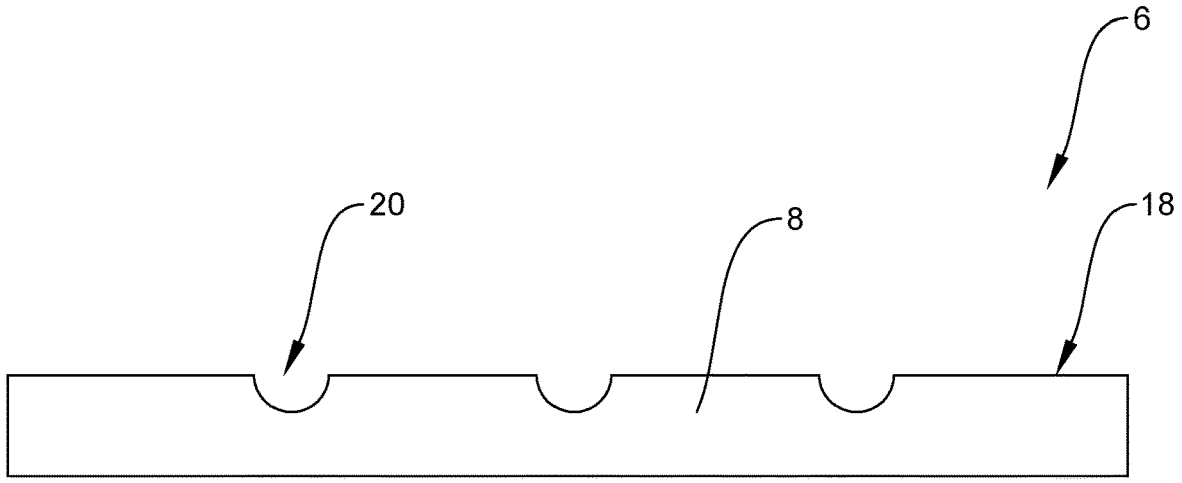
FIG. 3 schematically illustrates a part of the lateral wall of the transfer roller in a cross-sectional view.

As schematically indicated in FIG. 3, the depressions 20 can be formed by recesses arranged at the outside surface 18 of the lateral wall 8 of the transfer roller 6. The depressions 20 can have a predefined size and/or structure. A mean structure size of the depressions 20 can be in the range of 0.1 micrometer to 100 micrometer. In other words, each of the depressions 20 may have a microstructure.

Figure 4:
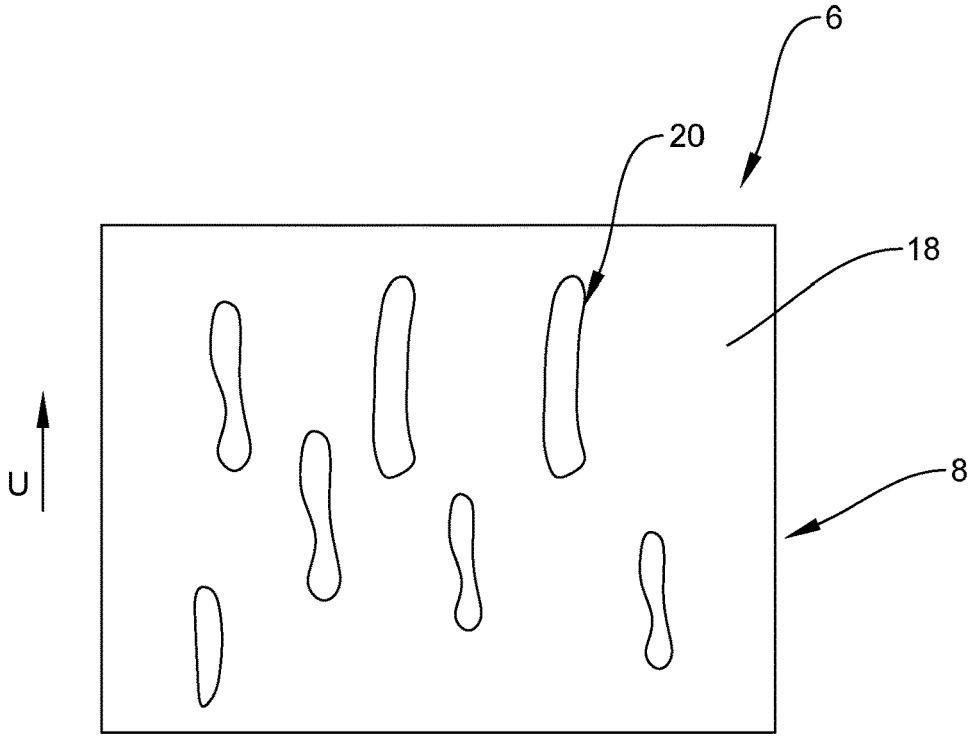
FIG. 4 schematically illustrates a further embodiment of the lateral wall of the transfer roller in a top view.

FIG. 4 exemplarily shows the depressions 20 of a part of the lateral wall 8 of the transfer roller 6 in a top view. Each of the depressions 20 may comprise an elongated extension in a circumferential direction U of the lateral wall 8 of the transfer roller 6.

Each of the depressions 20 is configured to receive lacquer and to transfer this received lacquer to a work surface 32 of a work piece 34, such as the surface of a wing component. Therefore, the several depressions 20 at the outside contact surface 18 of the lateral wall 8 may be arranged and/or formed according to a predefined structure, in particular a microstructure. The lateral wall 8 may be made of silicone, such that a damage of the wing surface 48 can be prevented.

If the depressions 20 are filled with a lacquer and if the outside contact surface 18 comes into contact with the work surface 32, the lacquer previously received in the depressions 20 is transferred to the work surface 32. This transferred lacquer has a structure, in particular microstructure, corresponding to a structure defined by depressions 20. Thus, the outside contact surface 18 with its depressions 20 is configured for embossing a lacquer-structure, in particular a lacquer-microstructure, on the work surface 32.

As schematically illustrated in FIG. 2, the slit nozzle 12 is directly or indirectly connected to the frame 4. Thus, the slit nozzle 12 may be mounted to the frame 4. Furthermore, the deformation unit 16 is directly or indirectly connected to the frame 4. For instance, the deformation unit 16 may be mounted on the frame 4. According to an example not illustrated in FIG. 2, the slit nozzle 12 and the deformation unit 16 may be formed by an integrated unit. But the slit nozzle 12 may also be directly connected to the deformation unit 16, or vice versa. Thus, the slit nozzle 12 and the deformation unit 16 may be mounted in series to the frame 4.

The device 2 also comprises the drive unit 10. The drive unit 10 is configured to drive the transfer roller 6 in a rotation direction K about the axis of rotation 22.

The lateral wall 8 of the transfer roller 6 is elastically deformable in a radial direction R of the transfer roller 6. The lateral wall 8 of the transfer roller 6 can be made of an elastomer plastic, a silicone or any other elastically deformable plastic material. The lateral wall 8 of the transfer roller 6 may be made of a synthetic, elastically deformable silicone. As a result, the lateral wall 8 can be at least sectionwise deformed in positive or negative radial direction R. The deformation unit 16 is configured to deform the lateral wall 8 in the radial direction R of the transfer roller 6 upstream from the slit nozzle 12 to provide a stable distance of the lateral wall 8 to the muzzle end 14 of the slit nozzle 12 for a defined application of lacquer to the outside contact surface 18 of the lateral wall 8. If references are made to the radial direction R, this may refer to the positive radial direction R or an opposite negative radial direction R.

The device 2 further comprises a hardening unit 60. The hardening unit 60 is configured for hardening the lacquer in a contactless way. The hardening unit 60 is formed by an UV-light unit. The hardening unit 60 is directly or indirectly connected to the frame 4. Moreover, the hardening unit 60 is arranged within the interior space 36 formed by the transfer roller 6. The lateral wall 8 of the transfer roller 6 is configured to transmit UV-light-waves. Thus, the lateral wall 8 is transparent for UV-light. The hardening unit 60 is arranged, such that UV-light is emitted towards the work surface 32 upon which the lateral wall 8 of the transfer roller 6 rolls. The lacquer is hardenable via UV-light. Therefore, the device is configured to control the drive unit 10 and/or the hardening unit 60 such that lacquer transferred to the work surface 32 is immediately hardened via UV-light emitted by the hardening unit 60.

The positioning device 3 is configured for holding the work piece 34 and moving the work piece 34 along the transfer roller 6, so that the transfer roller 6 rolls with the outside contact surface 18 on the work surface 32 of the work piece 34, for transferring lacquer from the depressions 20 to the work surface 32.

The device 2 is fixedly mounted to the base structure 44 by the frame 4. The positioning device 3 comprises a static base portion 46 fixedly mounted to the base structure 44, and a movable portion 48 movably mounted to the base portion 46 and including a work piece holder 50 for holding the work piece 34. The movable portion 48 includes a movable robot arm 52 movably mounted to the base portion 46 and holding the work piece holder 50, such that the work piece holder 50 is movable by the robot arm 52 relative to the base portion 46.

Figure 5:
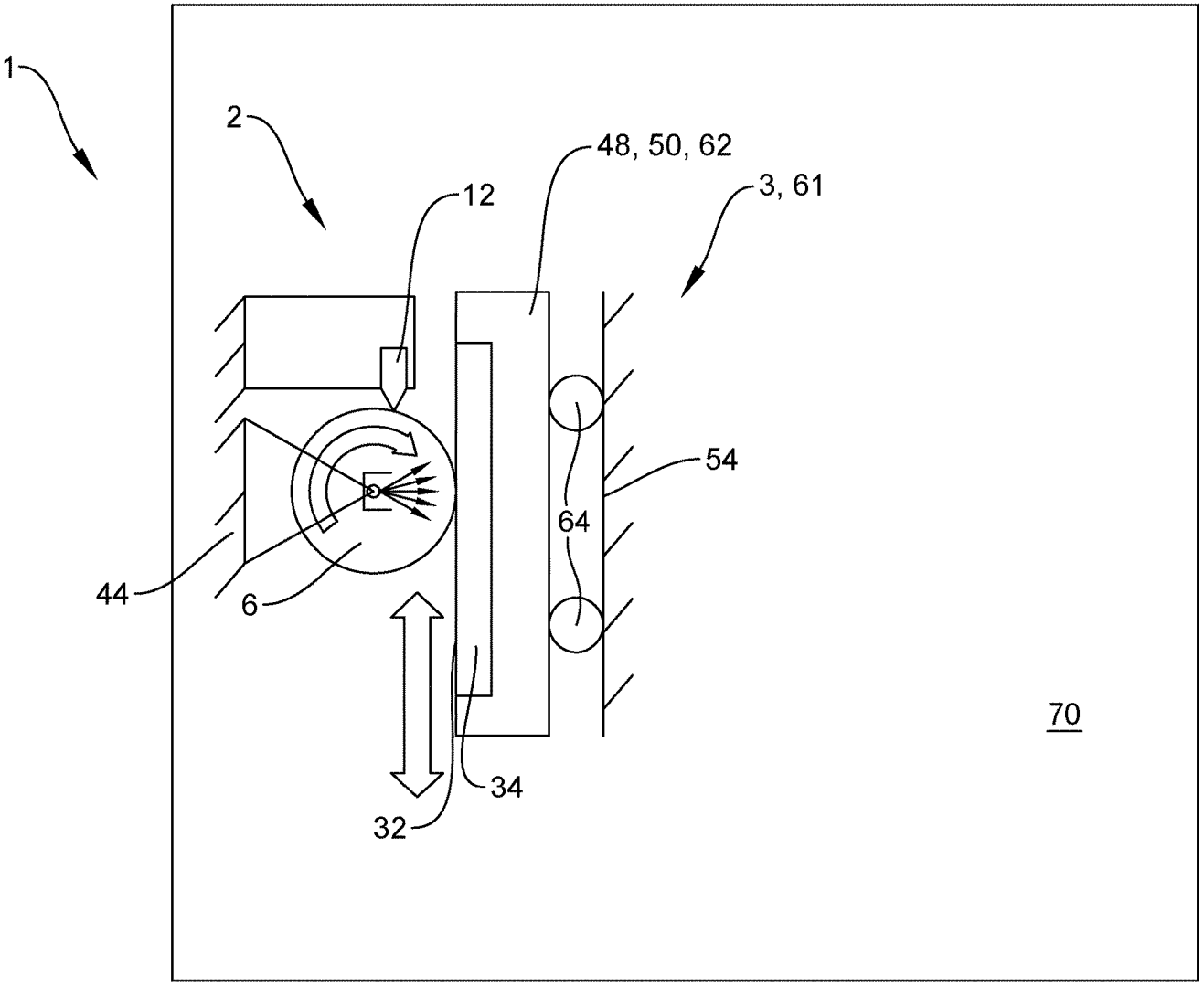
FIG. 5 schematically illustrates an alternative embodiment of the system for lacquer transfer, where the positioning device is formed as a roller system.

In FIG. 5 an alternative embodiment of the system 1 is shown where the positioning device 3, instead of being formed as a robot, is formed as a roller system 61, wherein the base portion 46 includes a roller track 54 and the movable portion 48 includes a carriage 62 engaged with the roller track 54 by rollers 64 and configured for moving along the roller track 54 and holding the work piece holder 50, such that the work piece holder 50 is movable by the carriage 62 relative to the roller track 54.

In both embodiments shown in FIGS. 1 and 5, the work piece holder 50 is formed as a jig adapted to the shape of the work piece 34. The work piece holder 50 includes a quick connector 66 for quickly coupling the work piece holder 50 to the movable portion 48 of the positioning device.

As shown in FIG. 1, the system 1 further comprises a preparation area 68 adjacent to the positioning device, for preparing work piece holders 50 with work pieces 34 attached thereto, i.e. for coupling the work pieces 34 to the corresponding work piece holders 50. The positioning device is configured such that the movable portion 48 can pick up or connect to the work piece holder 50 together with the work piece 34 from the preparation area 68.

As also shown in FIG. 1, the system 1 further comprises a lacquer transfer cell 70 housing the device 2 and the positioning device 3 and including the base structure 44. The lacquer transfer cell 70 comprises a door 72 in the form of an automatic shutter that is movable between a closed position where the lacquer transfer cell 70 is closed to the environment, and an open position where the lacquer transfer cell 70 is open to the preparation area 68, so that the movable portion 48 of the positioning device 3 can reach though the open door 72 and pick up to the work piece holder 50 together with the work piece 34 from the preparation area 68.

With the system 1 shown in FIG. 1 and described above, the following exemplary method for lacquer transfer can be carried out.

First of all, a work piece 34 is delivered to the preparation area 68. The work piece 34 is identified, e.g. by scanning an RFID tag or other code, and the work piece 34 identification data and status, in particular position, of the work piece 34 is transmitted to a centralized production management system. Then, the work piece 34 is attached to the work piece holder 50, and the related status update is transmitted to the production management system. Subsequently, parts of the work surface 32, such as start and stop areas, are masked by one or more masking elements 33, and once again, the work piece 34 status is updated. The work surface 32 of the work piece 34 is then activated, e.g. by grinding, laser or plasma application and a related status update is sent to the production management system. Afterwards, the work piece 34 is placed at a pick up position, and the status is updated.

As a next step, the door 72 of the lacquer transfer cell 70 is automatically opened and the work piece holder 50 with the work piece 34 attached thereto is picked up by the robot arm 52 of the positioning device 3 reaching through the opened door 72 and connecting to the quick connector 66 of the work piece holder 50. The positioning device 3, specifically a control unit of the positioning device 3, is then selecting or switching to application path data associated with the specific work piece 34 picked up. The positioning device 3 then positions the work piece 34 with the work surface 32 in front of the transfer roller 6 of the device 2 for lacquer transfer, whereupon the door 72 is automatically closed and a related status "ready for lacquer transfer" is transmitted to the production management system.

Subsequently, the work piece 34 is moved by the positioning device 3 along the transfer roller 6 according to the preselected application path, so that the transfer roller 6 rolls with the outside contact surface 18 on the work surface 32 of the work piece 34, for transferring lacquer from the depressions 20 to the work surface 32. When the intended lacquer transfer is completed, the device 2 is stopped and a related status is transmitted to the production management system. Afterwards, the door 72 is opened and the work piece 34 is moved by the positioning device 3 to a finishing area outside the lacquer transfer cell 70 and in or outside of the preparation area 68, for finishing steps, such as removing of masking and quality control, and the work piece status is updated. The work piece 34 is then handed over from the finishing area or from a specific hand over area. Finally, a status "ready for hand over" for the work piece and a status "ready for next work piece" for the lacquer transfer cell 70 is transmitted to the production management system.

By the present invention as described above, the device 2 does not need to be moved along the work surface 32 when transferring lacquer at the same time. Instead, the device 2 might be in a fixed position while the positioning device 3 moves the work piece 34 with the work surface 32 along the device 2. In such a way, a high quality of lacquer transfer can be achieved by a comparably simple system 1.

While at least one exemplary embodiment is disclosed herein, it should be understood that modifications, substitutions and alternatives may be apparent to one of ordinary skill in the art and can be made without departing from the scope of this disclosure. This disclosure is intended to cover any adaptations or variations of the exemplary embodiment (s). In addition, in this disclosure, the terms "comprise" or "comprising" do not exclude other elements or steps, the terms "a" or "one" do not exclude a plural number, and the term "or" means either or both. Furthermore, characteristics or steps which have been described may also be used in combination with other characteristics or steps and in any order unless the disclosure or context suggests otherwise. This disclosure hereby incorporates by reference the complete disclosure of any patent or application from which it claims benefit or priority.

The invention claimed is:

1. A system for lacquer transfer, comprising:

a device for lacquer transfer, comprising a frame, a transfer roller with a circumferential lateral wall, and a slit nozzle for dispensing lacquer, wherein the slit nozzle is connected to the frame, wherein an outside contact surface of the lateral wall comprises depressions, wherein the transfer roller is mounted rotatably about an axis of rotation to the frame, wherein the slit nozzle is arranged contactless to or in direct contact with the outside contact surface of the lateral wall for dispensing lacquer into respective depressions in the lateral wall while the transfer roller is rotated about the axis of rotation, wherein the transfer roller is configured to roll with the outside contact surface on a work surface of a work piece for transferring the lacquer from the depressions to the work surface of the work piece, wherein the system further comprises a positioning device configured for holding the work piece and moving the work piece along the transfer roller for transferring lacquer from the depressions to the work surface, wherein the positioning device is fixedly mounted to a base structure, and wherein the positioning device is mounted to the base structure such that the work piece is movable relative to the base structure, and wherein the positioning device is formed as a magnetic positioning device comprising a magnetic field generator fixedly mounted to the base structure and configured to generate and control a magnetic field, and a magnetic part configured for being moved within the magnetic field by adapting the magnetic field, and including a work piece holder for holding the work piece.

2. The system according to claim 1, wherein the positioning device comprises a base portion fixedly mounted to the base structure, and the magnetic part including the work piece holder for holding the work piece.

3. The system according to claim 1, wherein the work piece holder is formed as a jig adapted or adaptable to the shape of a specific work piece.

4. The system according to claim 3, wherein the work piece holder includes a connector for coupling the work piece holder to the magnetic part.

5. The system according to claim 3, further comprising a preparation area for preparing work piece holders with work pieces attached thereto, wherein the positioning device is configured such that a movable portion can pick up the work piece holder from the preparation area.

6. The system according to claim 1, further comprising a lacquer transfer cell housing the device for lacquer transfer and the positioning device and connected to or including the base structure.

7. The system according to claim 6, wherein the lacquer transfer cell comprises a door that is movable between a closed position where the lacquer transfer cell is closed to the environment, and an open position where the lacquer transfer cell is open to a preparation area, so that a movable portion of the positioning device can reach though the open door and pick up the work piece holder from the preparation area.

8. A method for lacquer transfer, comprising the steps of providing the system according to claim 1, and holding and moving a work piece with the positioning device along the transfer roller for transferring lacquer from the depressions to the work surface.

9. The method according to claim 8, wherein prior to transferring lacquer to the work piece, the work piece is attached to the work piece holder in a preparation area.

10. The method according to claim 9, wherein prior to or after attaching the work piece to the work piece holder, parts of the work surface are masked by one or more masking elements.

11. The method according to claim 9, wherein the magnetic part of the positioning device couples to the work piece holder and moves the work piece holder to the device for lacquer transfer.

* * * * *